United States Patent [19]

Tiller

[11] Patent Number: 5,022,656

[45] Date of Patent: Jun. 11, 1991

[54] TRAINING DEVICE FOR PUTTING

[76] Inventor: Ralph Tiller, 1534 Old Creek Ct., Cardiff, Calif. 92007

[21] Appl. No.: 484,425

[22] Filed: Feb. 23, 1990

[51] Int. Cl.[5] ..... A63B 69/36

[52] U.S. Cl. ..... 273/186 A; 273/191 B; 273/192

[58] Field of Search ..... 273/186 A, 191 B, 191 R, 273/191 A, 183 D, 192, 193 R, 193 B, 194 R

[56] References Cited

U.S. PATENT DOCUMENTS

| | | | |
|---|---|---|---|
| 1,536,512 | 5/1925 | McLaren | 273/186 A |
| 2,788,214 | 4/1957 | Tilden | 273/191 B |
| 3,232,623 | 2/1966 | Abrams et al. | 273/186 R |
| 4,353,556 | 10/1982 | Self et al. | 273/191 B |
| 4,535,991 | 8/1985 | Boatright | 273/191 B |

*Primary Examiner*—George J. Mario
*Attorney, Agent, or Firm*—David J. Harshman

[57] ABSTRACT

A training device for improving one's putting stroke has a long, slender rigid bar attached to the shaft of a putter. The bar is rigidly attached to extend rearward in an orientation perpendicular to the face of the head of the putter. A resilient, flexible line is attached to the bar. The line has one end adapted to be anchored to a stationary point, to maintain proper alignment of the putter face during a practice putting stroke. In another embodiment, a base is fixedly attached to the shaft, and a telescoping tube is hingedly connected to the base to allow vertical movement, but prevent lateral movement or rotation of the shaft during the practice stroke. In another embodiment, a base includes a flat end flange for vertical pivotal attachment by a clevis hinge to a long rigid rod, which passes through a stationary eye. Also included is a movable L-shaped member for establishing a proper angle for holding the putter.

5 Claims, 2 Drawing Sheets

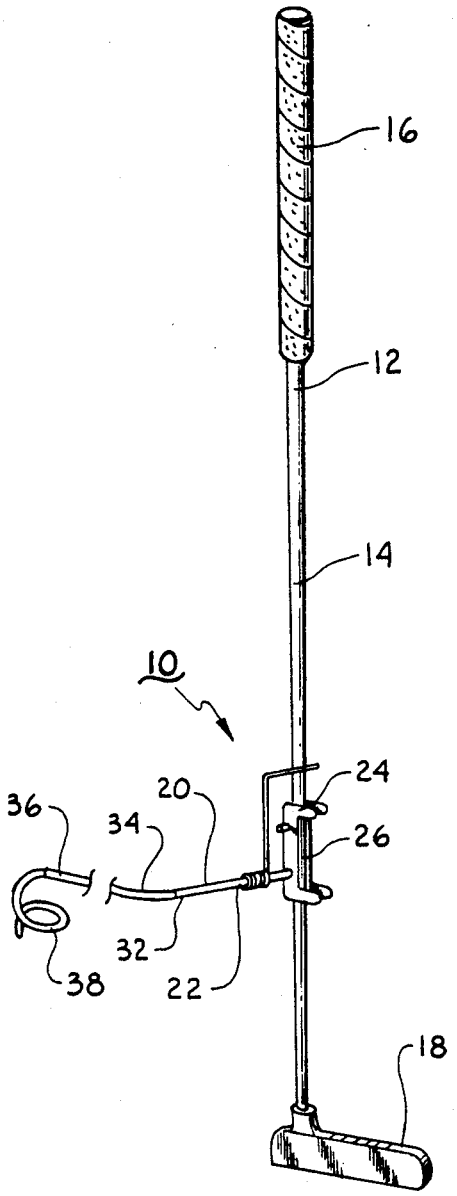
Fig. 1
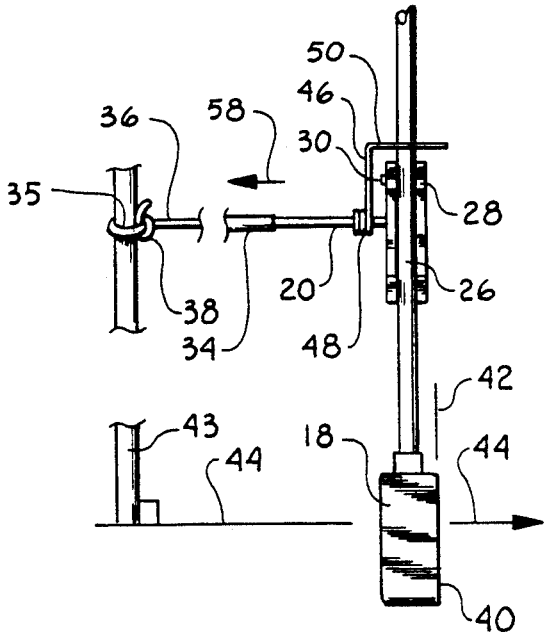
Fig. 2
Fig. 3
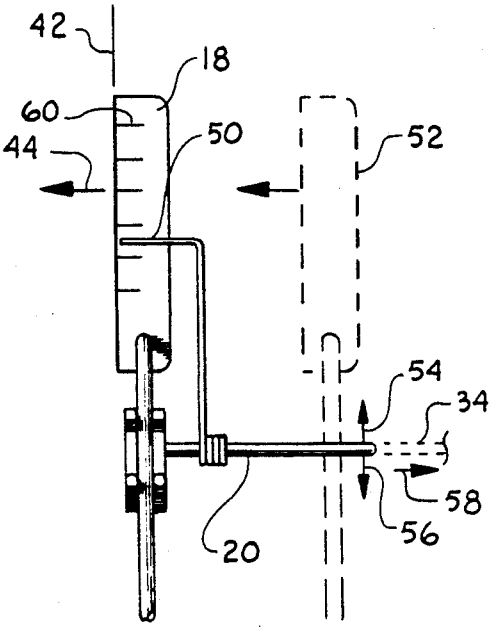

TRAINING DEVICE FOR PUTTING

FIELD OF THE INVENTION

This invention relates generally to devices for training individuals to have an improved golf game. More specifically, the invention relates to a training device which is removably attachable to a golf club for assisting the user in establishing a consistently accurate golf swing. The present invention is particularly, though not exclusively, useful as a training device for improving one's putting stroke.

BACKGROUND OF THE INVENTION

The game of golf is an exacting game requiring the combination of many skills to achieve superior performance. There have been many various attempts to design apparatus to assist a golfer in improving his or her game. An important part of the game, which some believe is the most important, is the putting game. Having the ability to consistently putt with accuracy is very desirable.

The accuracy of a golf ball hit along the green toward the hole is dependent on the accuracy of the user's putting stroke using the putter. A typical putter includes a shaft with a handle on one end, and a putting head attached to the opposite end. The putting head typically has a flat face for striking the golf ball. Generally, in making the stroke, it is desirable that the flat face be moved through the putting stroke by the golfer, so that the flat face is perpendicular to the line of intended travel of the golf ball when the putting head hits the golf ball. The position on the face at which the putting head strikes the golf ball, the angle of the face relative to the intended line of travel, and the force with which the head strikes the ball, determine in large part the direction and distance of the putt. The slope of the green and the type of grass also have an affect, but this can normally be taken into consideration in planning and executing a putting shot. If the golfer can consistently effect a straight putting stroke with the proper amount of force to place the ball into a desired path, one's putting game can be greatly improved.

The present invention recognizes that to improve the golfer's game, the golfer can read books and magazines, and watch videotapes and films, but that a superior method of training is accomplished by the golfer repetitively practicing the stroke. The present invention further recognizes that repeated practice of a stroke is not helpful, however, and may in fact teach bad habits, unless the stroke being practiced is the proper stroke. By proper stroke, it is meant that the putting stroke maintains proper perpendicular alignment of the putting head through the stroke, relative to the intended direction of the golf ball. In this manner, there is a higher probability the face will strike the ball at the desired right angle. Moreover, the proper amount of force should be exerted, which involves coordinated development of the appropriate arm and upper body muscles of the golfer to effortlessly and accurately complete the stroke. In addition, the present invention recognizes the need for such a training apparatus for improving one's putting stroke which can be removably attached to a conventional golf putter. After repeated practice, such a device could be detached from the putter, and if desired the same putter could then be used on the course.

Accordingly, it is an object of the present invention to provide a putting stroke training device which effectively improves one's putting game. It is another object of the present invention to provide such a device which maintains proper perpendicular alignment of the putting head throughout the practice stroke, to increase the consistency of the putting stroke. It is yet another object of the present invention to provide such a device which is durable and reliable, and cost-effective in its manufacture and use. It is another object of the present invention to provide such a device which is simple and convenient to use.

SUMMARY OF THE INVENTION

A preferred embodiment of the golf training device for improving one's putting stroke comprises a long, slender rigid bar with one end removably attached to the shaft of a putter which has a putting head with a face. The bar is attached to the portion of the shaft adjacent the putting head. The bar extends rearward in a direction substantially perpendicular to the plane of the face of the putting head, and is oriented substantially horizontal when the putter shaft is held by the golfer in a vertical position. At the free end of the bar, a resilient flexible line is attached. The flexible line is a stretchable, yet strong and light material, such as surgical tubing. The line extends for an appropriate distance sufficient to allow a full and complete putting stroke. The opposite end of the line has an apparatus for securing the line to a stationary object, which serves as an anchoring point. The securing apparatus includes a hook attached to the end of the resilient line which can be used to secure the line to a stationary object which lies in the intended line of travel, such as a heavy table leg.

As the putter is moved through the putting stroke, the resilient tube attached to the free end of the rigid bar maintains the bar in a direction substantially parallel to the intended line of travel of the golf ball. Any twisting by the golfer of the golf club or putter off the proper line of direction is resisted by the flexible line. Yet the resilient line permits completion of the practice putting stroke. Thus, the face of the putting head is maintained at a right angle, or perpendicular, to the intended direction or line of travel of the stroke, and the golf ball.

In another embodiment, the rigid bar and its attachment to the base are modified to include a substantially rigid telescoping tube which has one end hingedly attached to the base. The hinged connection of the telescoping tube to the base is such that when the base is secured to the club shaft, the telescoping tube may be articulated in the vertical plane, but not in a lateral plane. The telescoping tube is slidable longitudinally so it may be lengthened or shortened. Thus, when an opposite end of the telescoping tube is connected to a stationary object, the user is prevented from axial rotation of the club shaft and thus the club head throughout the practice stroke. The club face is maintained in its preferred perpendicular orientation to the line of travel during the practice stroke.

In yet another embodiment of the present invention, a clevis hinge is attached to an end flange and threaded into a face portion so that the end flange extends rearwardly in a substantially perpendicular direction to the plane of the club face. Rigidly attached to the clevis hinge is a rigid bar which passes through a stationary eye for aligning the stroke. The clevis hinge permits movement in a vertical plane, but restricts twisting movement of the club head. This allows completion of the stroke, yet maintains the club head in a position substantially perpendicular to the rod and thus to the intended line of the shot throughout the practice stroke.

A preferred embodiment further includes an L-shaped wire pivotally attached to either the bar, or telescoping tube. The L-shaped wire is oriented so the L is inverted, with the horizontal portion superposed above the putting head. The top of the putting head has indicator lines positioned at desired locations. The L-shaped wire is movable to a predetermined position The putter is held by the golfer at an angle to establish the horizontal portion of the L-shaped piece in the golfer's line of sight with the proper indicator mark on the putter head. This establishes the proper positioning and angle of inclination of the putter through the practice stroke.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 1 is a perspective view of a golf training device in accordance with the present invention in its intended environment;

FIG. 2 is a left side view of the golf training device in accordance with the present invention;

FIG. 3 is a top view of the golf training device in accordance with the present invention;

DESCRIPTION OF THE PREFERRED EMBODIMENT

Figure 4:
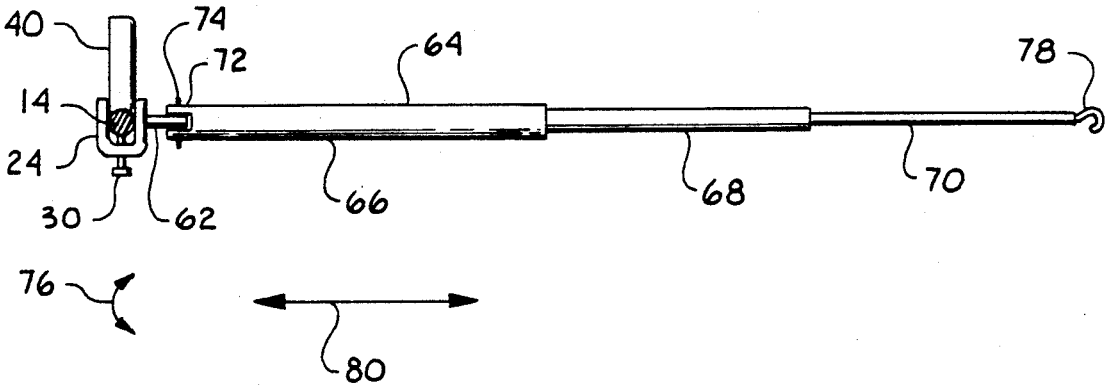
FIG. 4 is a top view of an alternative embodiment of the golf training device in accordance with the present invention.

Referring now to FIGS. 1 and 2, there is shown a golf training device generally designated 10, shown in its intended environment. Device 10 is rigidly attached to a conventional putter 12. Putter 12 has a shaft 14, handle 16, and putting head 18.

Device 10 comprises a long, slender rigid bar 20, which may advantageously be made of stainless steel or rigid sturdy plastic material. The bar 20 is also light so as not to unduly affect the stroke. Bar 20 has one end 22 connected to a base 24. Base 24 is removably attached to portion 26 of shaft 14 which adjoins putting head 18. A clamping mechanism is incorporated into base 24 for attaching bar 20 to shaft 14, which includes flanges 28 which extend about shaft portion 26. Flanges 28 can be adjustably tightened by set screw 30 onto shaft portion 26 to hold base 24 rigidly in position as desired. At opposite end 32 of bar 20, there is attached a flexible line 34, which as more fully explained below serves to maintain proper orientation of the shaft 14 and club head 18. Flexible line 34 is a resilient yet sturdy line which provides sufficient flexibility for operation of the device. One material which has been found to work advantageously is ¼ inch surgical tubing, approximately six (6) to eight (8) feet in length. In addition, bar 20 is approximately one (1) foot long. Bar 20 should be of a length which is sufficient to provide a suitable moment arm about shaft 14 to keep putter 12 in alignment, yet without interfering in the golfer's practice swing. At an opposite end 36 of line 34 is a securing apparatus 38, such as a hook in the embodiment shown, for securing end 36 about a stationary object to anchor line 34. The stationary object is an object which allows end 36 to be secured at a point 35 which is in a vertical plane 43 which lies on the intended line of direction of the path of the golf ball (not shown).

Bar 20 is clamped rigidly onto shaft 14 in the orientation more clearly shown in FIG. 2. In particular, putting head 18 has on its forward edge a generally flat putting face 40, which lies substantially in a plane 42. Bar 20 is attached to shaft portion 26 so it is rigidly oriented in a direction substantially at right angles, or perpendicular, to face 40, which face 40 lies in perpendicular plane 42. In addition, it is to be noted that bar 20 lies in a direction which is substantially parallel to the intended line of direction 44 of the path of the golf ball after it is hit by head 18.

Device 10 may further include a generally L-shaped wire 46 movably attached at pivot 48 to bar 20. L-shaped wire 46 has a horizontal member 50 which is positionable so that it is superposed above head 18. The operation of the method of the present invention can be perhaps best appreciated with reference to FIG. 3.

As shown in FIG. 3, as the practice putting stroke is effected by the golfer using device 10, the putting head 18 is in a position 52, rearward or aft of the direction of the intended path of the ball. During the stroke, if the golfer inadvertently or otherwise moves putter 12 to move face 40 out of plane 42, which plane 42 is perpendicular to line 44 of the intended direction of the ball, end 32 of bar 20 is deflected. End 32 thus moves as shown by deflection arrows 54, 56. However, resilient line 34 exerts force 58 which tends to counteract any such deflective movement. Thus, any movement of the club which tends to move face 40 out of plane 42 is resisted, and proper alignment of face 40 in plane 42, perpendicular to line 44, is maintained throughout the stroke. By repeated strokes made by the golfer using device 10, a proper feel is developed by the golfer in which the face remains properly aligned throughout the stroke. Once developed, this feel can be replicated on the golf course by the golfer without the training device. In so doing, the probability of hitting the golf ball squarely with the face 40 perpendicular to the intended line of travel 44 is greatly increased. In addition, force 58 exerted by line 34 allows strengthening and development of proper muscles of the golfer used during a properly oriented putting stroke.

Referring now to FIG. 4, there is shown an alternative embodiment of the golf training device in accordance with the present invention. In particular, FIG. 4 shows a top view of the alternative embodiment of the device, looking at a cross-sectional view taken at a right angle to the longitudinal axis of shaft 14. In particular, base 24 is rigidly attached to shaft 14 by means of set screw 30. Fixedly connected to base 24 is extension portion 62. Hingedly connected to extension portion 62 is a telescoping tube 64. As can be seen in FIG. 4, in the embodiment shown, telescoping tube 64 comprises a plurality of hollow cylindrical sections 66, 68 and 70 which fit one inside the other. Sections 66, 68 and 70 are substantially rigid, yet made of a sturdy and light material, which slide easily, one section inside the other. Widest section 66 has an end which includes a pair of flanges 72. Flanges 72 fit over extension portion 62 to form a hinged connection via pin 74. As can be appreciated with reference to the operation of flange 72 on extension portion 62, the telescoping tube 64 is thus able to articulate in a vertical plane, along the same general direction of shaft 14 of putter 12. However, rotational movement as shown by arrow 76 of putter 12 is effectively prevented by the hinged connection in which extension portion 62 is movably seated within flanges 72. At an opposite end on section 70 of telescoping shaft 64 is a hook 78 for connecting the other end of the telescoping tube 64 to a stationary object, as can be seen in FIG. 4. It is important to note also that in the telescoping action of telescoping tube 64, hollow sections 66, 68 and 70 are of sufficient length such that they also substantially prevent any lateral movement or deflection in the direction generally indicated by arrow 76. The action of the telescoping tube 64 via its hinged connection, is essentially limited to movement in the longitudinal direction generally indicated by the arrow 80. Thus, when hook 78 of the telescoping tube 64 is connected to a stationary object to establish the line of travel of the intended shot as represented by arrow 80, the user is prevented from rotating the club shaft 14 during the practice stroke. In effect, the club face 40 is maintained in its preferred perpendicular orientation to the line of travel represented by arrow 80 during the practice stroke. The telescoping tube 64 expands and contracts as necessary to allow the user to accomplish the putting stroke without interference in the forward and aft motion along arrow 80, but effectively maintains the proper perpendicular orientation of club face 40.

Figure 5:
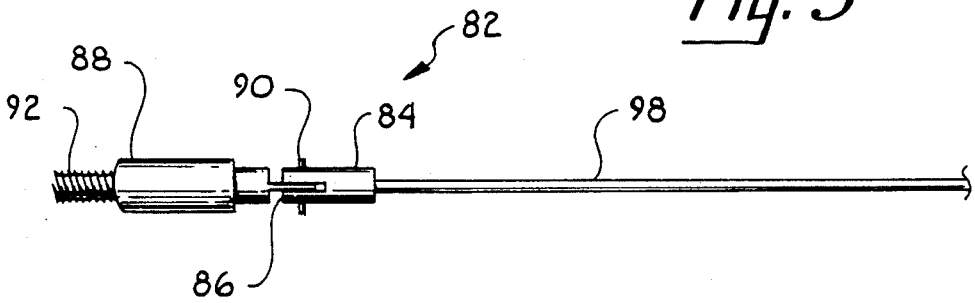
FIG. 5 is a top view of another embodiment of the golf training device in accordance with the present invention.
Figure 6:
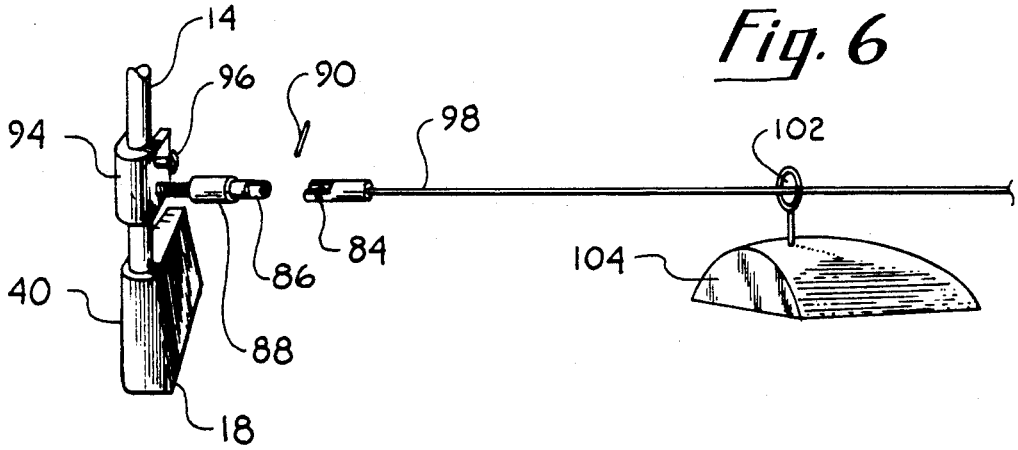
FIG. 6 is a rear perspective view of the embodiment shown in FIG. 5 attached to a putter.
Figure 7:
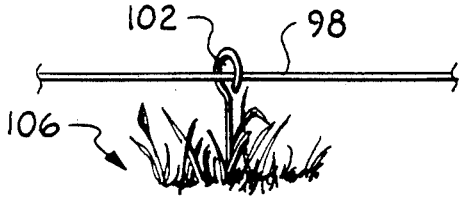
FIG. 7 is an alternative embodiment of an eye for use with the embodiment of FIGS. 5 and 6.

Referring to FIGS. 5–7, there is shown yet another embodiment of the present invention. In particular, golf training device 82 comprises a clevis hinge 84 attached to flat end flange 86 which is threaded into sleeve extension portion 88. A pin 90 pivotally attaches clevis hinge 84 to flange 86. A threaded portion 92 has one end rigidly secured in sleeve 88, and the other end formed for threadable engagement with base 94. End flange 86 thus extends rearwardly in a direction substantially perpendicular to the plane of club face 40. Base 94 is securely coupled by set screw 96 to shaft 14 near head 18. Rigidly attached to clevis hinge 84 is a long, slender rigid rod 98. Rod 98 may be one piece, or a sectional assembly like a gun cleaning rod, for ease of handling when not in use. Sleeve extension portion 88 may be adjusted to permit alignment of clevis hinge 84 so that the pivotal movement of rod 98 about clevis hinge 84 is limited to being within a substantially vertical plane. Positioned at a predetermined distance from club head 18 is a guide member 100. Guide member 100 includes a stationary eye 102, such as a ring or hook, which is mounted in a weighted base 104, or is placed in ground 106. Rod 98 is slidable back and forth during a practice stroke through eye 102, with clevis hinge 84 allowing vertical movement of head 18, but preventing any horizontal twisting movement of head 18. Eye 102 is placed on the intended line of travel of the shot. Face 40 of head 18 is kept in a position substantially perpendicular to rod 98 and thus to the intended line of travel of shaft 14 throughout the practice stroke.

To further improve the golfer's accuracy and consistency of the stroke, horizontal member 50 of L-shaped wire 46 can be aligned in the golfer's line of sight with indicator marks or lines 60 on top of head 18 when practicing with the device 10. This permits the proper angle and positioning of putter 12 to be made in consistent fashion, for proper stance of the golfer with respect to the golf ball, which affects the stroke. Thus, repeated practice strokes using the present invention develop the proper muscles of the golfer, and a feel by the golfer for a properly aligned putter stroke.

While the particular training device for putting as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. A training device for improving a golfer's putting stroke to hit a golf ball in an intended line of travel for use in combination with a putter having a shaft and a putting head with a face, comprising:

a base rigidly attachable to said shaft adjacent said head;

a slender rigid bar rigidly attached to said base which extends in a rearward direction perpendicular to the face, and having a free end; and an elastic line having one end attached to said free end, and a second end attachable to a stationary object which is positioned in a vertical plane which lies on the intended line of travel.

2. A training device as recited in claim 1, further comprising an L-shaped member movably attached to said bar, said L-shaped member having a horizontal portion for being superposed above the putting head in the golfer's line of sight with said head.

3. A training device as recited in claim 2, wherein said elastic line includes means for securing said free end to said stationary point.

4. A training device as recited in claim 3, including a putter having a putting head with indicating marks on the top thereof.

5. A training device as recited in claim 4, wherein said bar includes means for removably attaching said base to said shaft.

* * * * *